United States Patent [19]

Nicoll

[11] Patent Number: 4,500,489

[45] Date of Patent: Feb. 19, 1985

[54] HIGH TEMPERATURE PROTECTIVE COATING ALLOY

[75] Inventor: Andrew R. Nicoll, Oftersheim, Fed. Rep. of Germany

[73] Assignee: BBC Aktiengesellschaft Brown, Boveri & Cie, Baden, Switzerland

[21] Appl. No.: 445,714

[22] Filed: Nov. 30, 1982

[30] Foreign Application Priority Data

Dec. 5, 1981 [DE] Fed. Rep. of Germany ..... 3148198

[51] Int. Cl.[3] ..... C22C 19/05

[52] U.S. Cl. ..... 420/445; 420/449

[58] Field of Search ..... 420/446, 445, 449; 148/410, 428

[56] References Cited

U.S. PATENT DOCUMENTS 4,054,723 10/1977 Higginbotham et al. ..... 420/446

*Primary Examiner*—Dean R.

*Attorney, Agent, or Firm*—Oblon, Fisher, Spivak, McClelland & Maier

[57] ABSTRACT

The invention refers to a high temperature protective coating which is formed by an alloy of chromium, silicon, boron, iron and nickel. According to the invention, a light metal is mixed into the alloy as an additive. The additive consists preferably of aluminum. In addition, the silicon content of the high temperature protective coating is limited to 1.1 to 3.5 percent in weight relative to the total weight of the alloy.

2 Claims, No Drawings

HIGH TEMPERATURE PROTECTIVE COATING ALLOY

BACKGROUND OF THE INVENTION

1. Field of the Invention

This invention is directed to a high temperature protective coating composition, particularly for the protection of steel elements exposed to high temperatures in the presence of corrosive agents.

2. Description of the Prior Art

High temperature protective coatings of the type addressed herein are mainly used in cases where the basic material of the construction elements made from heat resistant steels and/or alloys is to be protected at temperatures above 600° C. These high temperature protective coatings are designed to slow down the high temperature corrosion caused mainly by sulphur and oil ashes. The high temperature protective coatings are applied directly to the basic material of the construction element. Such high temperature protective coatings are of special importance on construction elements of gas turbines. They are mainly applied to rotating or guide blades as well as to the heat accumulation segments of gas turbines. By preference, an austenitic material based on nickel, cobalt or iron is used for the manufacture of these construction elements. Nickel super alloys are the basic material principally used in the making of gas turbine parts. The high temperature protective coating to be applied consists preferably of alloys containing chromium.

A high temperature protective coating for gas turbine parts has been known from DE-OS No. 28 16 520. The protective coating consists of a matrix, containing 40 to 60 percent in weight nickel, 15 to 30 percent in weight chromium and 3 to 6 percent in weight boron. The stated weights refer to the total weight of the matrix. In addition, 30 to 40 percent per volume chromium boride—with reference to the total volume of the alloy—is dispersed into the protective coating.

The protective action of this high temperature protective coating is based on the fact that when corrosion occurs, corrosion products form in the shape of covering layers which are corrosion resistant and cover the surface uniformly, homogeneously, tightly and lastingly so that the basic material of the parts is protected from further corrosion attacks. These covering layers that contain mainly chromium oxide, are compatible with the protective layer, chemically as well as mechanically, and are insensitive to shocklike thermal and/or mechanical stress.

However, the high temperature protective coating described above has the disadvantage that the chromium containing covering layer is steamed off at temperatures above 900° C. This leads to a rapid consumption of the high temperature protective coating, especially at the temperatures stated above.

For this reason, the problem addressed was to create a high temperature protective coating in such a way that its wear and tear is lastingly stopped, even when temperatures are above 900° C.

SUMMARY OF THE INVENTION

To achieve the above-stated objects, and to avoid wear and tear on the applied high temperature protective coating, even at temperatures above 900° C., aluminum is mixed as an additive into the alloy forming the high temperature protective coating according to the invention. The additive is, e.g., mixed into the powder for the alloy during the manufacturing process. Further, the silicon content of the alloy is limited as compared to the already known high temperature protective coatings on the basis of chromium, silicon, boron, iron and nickel.

DETAILED DESCRIPTION OF THE INVENTION AND PREFERRED EMBODIMENTS

In the protective coating alloy of this invention the silicon content may not exceed 3.2 percent in weight. The weight refers to the total weight of the alloy. However, the silicon content should not be below 1.1 percent in weight. A preferred composition of the alloy according to the invention incorporating aluminum as an additive consists of 17.2 to 17.8 percent in weight chromium, 4 to 5.1 percent in weight aluminum, 1.1 to 3.2 percent in weight silicon, 4.5 percent in weight iron, 3.5 percent in weight boron. The remaining part of the alloy is nickel.

The addition of aluminum to the alloy which forms the high temperature protective coating has the effect that the aluminum is diffused to the surface of the protective layer during operating conditions when the high temperature protective coating is thermally stressed. There, the aluminum forms a covering layer of aluminum oxide with the oxygen containing atmosphere. This covering layer is resistant against high temperature corrosion. At temperatures above 900° C. there is no indication of any steaming off of the aluminum oxide covering layer. The aluminum oxide covering layer according to the invention protects the high temperature protective coating from a rapid wear and tear and therefore contributes to the lasting protection of the actual construction element. The formation of the aluminum oxide covering layer is favored by the limitation of the silicon content.

In an alternative preferred embodiment, the formation of an aluminum oxide covering layer can also be improved by doping the alloy with titanium. If the alloy is additionally doped with titanium, it is not necessary to limit the silicon share within the alloy to an amount of less then 3.5 percent in weight. An alloy doped with titanium has preferably the following composition: 2 to 6 percent in weight titanium, 5 to 5.5 percent in weight aluminum, 1.1 to 4.5 percent in weight silicon, 16.5 to 17.5 percent in weight chromium, 4.5 percent in weight iron, 3.5 percent in weight boron. The remaining share of the alloy is nickel.

The stated weights refer to the total weight of the alloy. The invention may be further understood by reference to the example set forth below.

EXAMPLE

The invention is explained in more detail based on an example which describes the manufacture of a coated gas turbine part. The high temperature protective coating according to the invention is applied to the part which is particularly exposed to the effects of hot gases. The coating of the part is done with a plasma spray process. The basic material of the part to be coated is a nickel super alloy, particularly IN 738. The powder which forms the high temperature protective coating consists of 17.3 percent in weight chromium, 4.0 percent in weight aluminum, 3 percent in weight silicon, 4.5 percent in weight iron and 3.5 percent in weight boron. The remaining share of the alloy is nickel. The stated weight refers to the total weight of the alloy. The aluminum which is added to the alloy can be mixed with the remaining metals forming the alloy or rather with the metal compounds, during the manufacture of the powder. Before applying the high temperature protective coating, the part is cleaned and degreased with chemical and/or mechnical means. Then, all areas that are not to be coated have to be covered. For this purpose sheet metal or graphite coverings are suitable. The areas to be coated are then mechnically roughened. The application of the powder which forms the high temperature protective coating is done with plasma sprayers. The high temperature protective coating is applied directly to the basic material of the part. As a plasma gas argon is used in the amount of about 1.2 $Nm^3/h$. The plasma current is 480 amperes, the applied voltage 60 volts. After the application of the alloy to the basic material, the part is subjected to a heat treatment. This is done in a high vacuum annealing furnace. In it a pressure p is sustained that is smaller then $5\times10^{-4}$ torr. After reaching a vacuum, the oven is heated to a temperature of between 1080° C. and 1140° C. At this temperature the high temperature protective coating becomes at least partially liquid. This closes its pores. In addition, there is a diffusion of the coating material into the basic material of the part. During the plasma spraying itself the coating material is only mechanically connected to the basic material. The temperature stated above is maintained for about one hour with a tolerance of about plus/minus 4° C. Then, the heater is the oven is turned off. The coated, heat treated part cools slowly in the oven.

Although the invention has been described with reference to specific embodiments, particularly with respect to the weight percentage of various components of the invention, the embodiments are advanced for illustrative purposes only. Variations will occur to those of skill in the art without the exercise of inventive faculty, which remain within the scope of the invention as claimed below.

I claim:

1. A high temperature protective coating alloy consisting essentially of aluminum in 4–5.1 % by weight, silicon in 1.1–3.2% by weight, chromium in 17.2–17.8% by weight, iron at about 4.5% by weight, boron at about 3.5% by weight, the balance being nickel.

2. A high temperature protective coating alloy consisting essentially of titanium in 2–6% by weight, aluminum in 5.5% by weight, silicon in 1.1–4.5% by weight, chromium in 16.5–17.5% by weight, iron in about 4.5% by weight, boron in about 3.5% by weight, the balance being nickel.

* * * * *